US006829903B2

(12) United States Patent
Lee et al.

(10) Patent No.: US 6,829,903 B2
(45) Date of Patent: Dec. 14, 2004

(54) AIR CONDITIONER AND METHOD FOR OPERATING AIR CONDITIONER IN COOLING MODE

(75) Inventors: Won Hee Lee, Seoul (KR); Cheol Min Kim, Kyunggi-do (KR); Yoon Jei Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/638,316

(22) Filed: Aug. 12, 2003

(65) Prior Publication Data

US 2004/0118135 A1 Jun. 24, 2004

(30) Foreign Application Priority Data

Dec. 20, 2002 (KR) ..... 10-2002-0081723

(51) Int. Cl.[7] ..... F25B 1/00; F25B 49/00

(52) U.S. Cl. ..... 62/229; 62/175; 62/228.4; 62/510

(58) Field of Search ..... 62/229, 175, 510, 62/228.4, 157, 158, 160, 231; 417/12, 290

(56) References Cited

U.S. PATENT DOCUMENTS 5,050,397 A * 9/1991 Sugiyama et al. ..... 62/175
5,060,486 A * 10/1991 Linstromberg ..... 62/229
5,927,088 A * 7/1999 Shaw ..... 62/175
6,705,097 B2 * 3/2004 So et al. ..... 62/158
2003/0230097 A1 * 12/2003 Moon et al. ..... 62/175

* cited by examiner

*Primary Examiner*—Marc Norman
(74) *Attorney, Agent, or Firm*—Greenblum & Bernstein, P.L.C.

(57) ABSTRACT

Disclosed are an air conditioner, which reduces an electric power consumption rate and rapidly copes with the requirements of a user, and a method for operating the air conditioner in a cooling mode for cooling air in a room by an independent or simultaneous operation of small-capacity and large-capacity compressors in accordance with the variation of a cooling load. The method comprises the steps of (a) operating the small-capacity compressor; (b) stopping the operation of the small-capacity compressor and operating the large-capacity compressor when it is determined that the room temperature is higher than a first set temperature after the lapse of a first predetermined time after the small-capacity compressor is operated at the step (a); and (c) re-operating the small-capacity compressor together with the operation of the large-capacity compressor when it is determined that the room temperature is higher than a second set temperature after the lapse of a second predetermined time after the large-capacity compressor is operated at the step (b).

15 Claims, 4 Drawing Sheets

AIR CONDITIONER AND METHOD FOR OPERATING AIR CONDITIONER IN COOLING MODE

BACKGROUND OF THE INVENTION

1. Field of the Invention

The present invention relates to an air conditioner and a method for operating the air conditioner in a cooling mode, and more particularly to an air conditioner in which operating modes of compressors are changed when a cooling load to be eliminated is large and a method for operating the air conditioner in a cooling mode.

2. Description of the Related Art

Generally, an air conditioner is an appliance for cooling or heating a room using a refrigerating cycle of a refrigerant compressed into a high-temperature and high-pressure state by compressors.

FIG. 1 is a schematic view of a conventional air conditioner.

As shown in FIG. 1, the conventional air conditioner comprises an indoor heat exchanger 2 for heat-exchanging air in a room with a refrigerant, thereby cooling or heating the room, an outdoor heat exchanger 4 serving as a condenser for condensing the refrigerant when the indoor heat exchanger 2 functions as a cooler, while serving as an evaporator for evaporating the refrigerant when the indoor heat exchanger 2 functions as a heater, a compressor 6 for compressing the refrigerant from a low-temperature and low-pressure gaseous state into a high-temperature and high-pressure gaseous state in order to supply the high-temperature and high-pressure gaseous refrigerant to the indoor heat exchanger 2 or outdoor heat exchanger 4, an expansion device 8 arranged between the indoor heat exchanger 2 and the outdoor heat exchanger 4 and adapted to expand the refrigerant into a low-temperature and low-pressure state, an operating panel 12 for allowing a user to manipulate the operation of the air conditioner, a temperature sensor 14 for sensing a room temperature, and a control unit 16 for controlling operation of the compressor 6 in response to the manipulation of the user and in accordance with an indoor cooling or heating load to be eliminated. The indoor heat exchanger 2, the outdoor heat exchanger 4, the compressor 6, and the expansion device 8 are connected by a refrigerant pipe 9.

The reference numeral 24 denotes a common accumulator to which a suction line 6*a* of the compressor 6 is connected. This common accumulator 24 serves to store the refrigerant in a liquid state not evaporated by the indoor heat exchanger 2 or outdoor heat exchanger 4, in order to prevent the liquid refrigerant from being introduced into the compressor 6. Introduction of such a liquid refrigerant into the compressor 6 may cause failure of the compressor 6.

Also, the reference numeral 26 denotes a direction change valve, for example, a 4-way valve, adapted to change the flow direction of the refrigerant in accordance with a control signal from the control unit 16 so that the air conditioner is used for a cooling or heating purpose. This 4-way valve 26 communicates with the common accumulator 24 and a discharge line 6*b* of the compressor 6. The 4-way valve 26 guides the high-temperature and high-pressure gaseous refrigerant compressed by the compressor 6 to the outdoor heat exchanger 4 in a cooling mode, while it guides the same gaseous refrigerant to the indoor heat exchanger 2 in a heating mode.

Now, a method for operating the above-described conventional air conditioner in the cooling mode will be described in detail.

First, the air conditioner is set to be operated in a cooling mode under the condition in which a target temperature $T_0$ is set, and the control unit 16 switches the operating position of the 4-way valve 26 to correspond to the cooling mode, as shown in FIG. 1.

The control unit 16 compares a room temperature sensed by the temperature sensor 14 with the target temperature $T_0$ set by a user via the operating panel 12. When the room temperature is not lower than the target temperature $T_0$, the control unit 16 operates the compressor 6. When the room temperature is lower than the target temperature $T_0$, the control unit 16 stops the operation of the compressor 6.

When the compressor 6 is operated, the compressor 6 discharges a high-temperature and high-pressure gaseous refrigerant to the outdoor heat exchanger 4. When the refrigerant passes through the outdoor heat exchanger 4, the refrigerant is heat-exchanged with the peripheral air, thereby radiating heat and then being condensed into a high-temperature and high-pressure liquid state. Then, the condensed refrigerant in the high-temperature and high-pressure liquid state passes through the expansion device 8, thereby being expanded into a low-temperature and low-pressure state inducing evaporation. When the expanded refrigerant passes through the indoor heat exchanger 2, the refrigerant is heat-exchanged with indoor air, thereby absorbing heat and then being evaporated. Then, the refrigerant is introduced again into the compressor 6. Thereby, a cooling cycle is established.

Recently, in order to meet a trend towards large scale and multi-function applications, air conditioners have been developed to comprise two or more compressors. The total capacity of the plural compressors is variably changed in accordance with a cooling or heating load in a room to be eliminated. Accordingly, it is possible to reduce power consumption required to operate the plural compressors and to rapidly cope with the variation of the cooling or heating load.

Since the earlier conventional air conditioner in a cooling mode operates a single compressor 6 and stops the operation of the compressor 6 by comparing a room temperature with a target temperature. Further, since the recently developed air conditioner comprising the plural compressors operates the plural compressors simultaneously and stops the operation of the plural compressors simultaneously even when a cooling load in a room to be eliminated is small, it is difficult to reduce an electric power consumption rate.

SUMMARY OF THE INVENTION

Therefore, the present invention has been made in view of the above problems, and it is an object of the present invention to provide an air conditioner for reducing an electric power consumption rate and a method for operating the air conditioner in a cooling mode.

It is another object of the present invention to provide a method for operating an air conditioner in a cooling mode, which rapidly copes with the requirements of a user.

In accordance with one aspect of the present invention, the above and other objects can be accomplished by the provision of an air conditioner comprising: small-capacity and large-capacity compressors for compressing a refrigerant; a temperature sensor for sensing a room temperature; an operating panel for allowing a user to manipulate the air conditioner and to input a target temperature therethrough;

and a control unit for determining a cooling load in a room to be eliminated by comparing the room temperature sensed by the temperature sensor with upper and lower temperature limits being higher and lower than the target temperature by an allowable deviation, and for controlling an independent or simultaneous operation of the small-capacity and large-capacity compressors so that the room temperature is maintained in the range of the upper and lower temperature limits when it is determined that the cooling load is large.

In accordance with another aspect of the present invention, there is provided a method for operating an air conditioner in a cooling mode for cooling air in a room by an independent or simultaneous operation of small-capacity and large-capacity compressors in accordance with the variation of a cooling load, comprising the steps of: (a) operating the small-capacity compressor; (b) stopping the operation of the small-capacity compressor and operating the large-capacity compressor when it is determined that the room temperature is higher than a first set temperature after the lapse of a first predetermined time after the small-capacity compressor is operated at the step (a); and (c) re-operating the small-capacity compressor together with the operation of the large-capacity compressor when it is determined that the room temperature is higher than a second set temperature after the lapse of a second predetermined time after the large-capacity compressor is operated at the step (b).

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
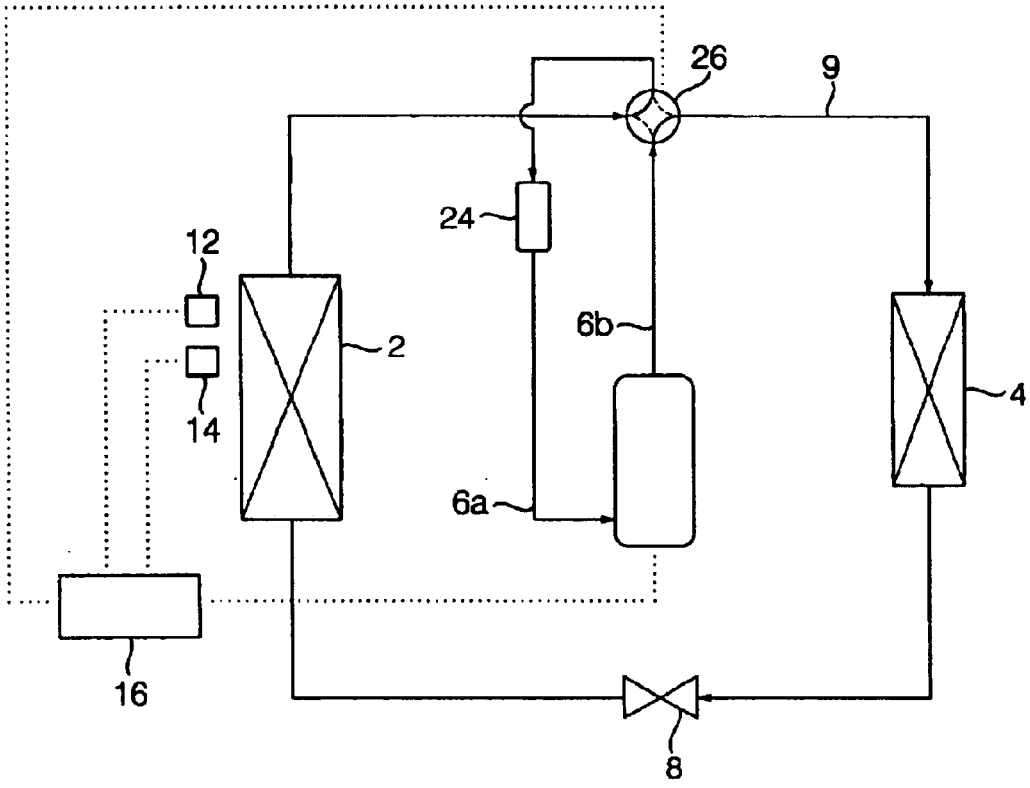
FIG. 1 is a schematic view of a conventional air conditioner.
Figure 2:
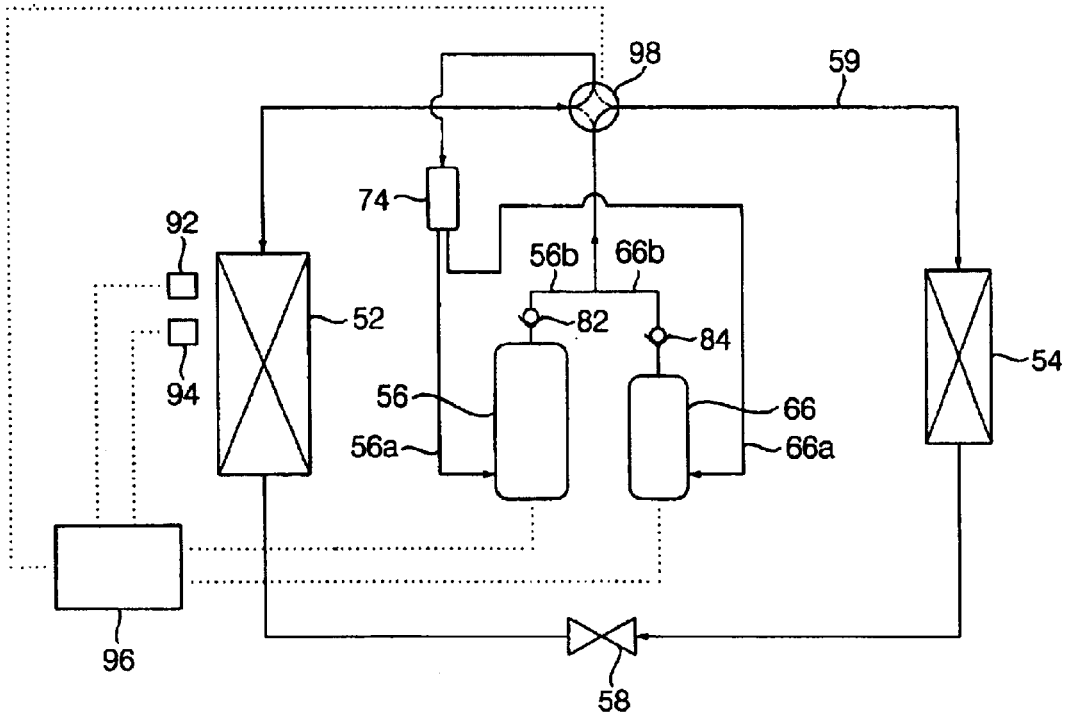
FIG. 2 is a schematic view of an air conditioner in accordance with an embodiment of the present invention.

FIG. 2 is a schematic view of an air conditioner in accordance with an embodiment of the present invention.

As shown in FIG. 2, the air conditioner of the present invention comprises an indoor heat exchanger 52 for heat-exchanging air in a room with a refrigerant, thereby cooling or heating the room air, an outdoor heat exchanger 54 serving as a condenser for condensing the refrigerant when the indoor heat exchanger 52 functions as a cooler, while serving as an evaporator for evaporating the refrigerant when the indoor heat exchanger 52 functions as a heater, small-capacity and large-capacity compressors 56 and 66 for compressing the refrigerant from a low-temperature and low-pressure gaseous state into a high-temperature and high-pressure gaseous state in order to supply the high-temperature and high-pressure gaseous refrigerant to the indoor heat exchanger 52 or the outdoor heat exchanger 54, and an expansion device 58 arranged between the indoor heat exchanger 52 and the outdoor heat exchanger 54 and adapted to expand the refrigerant into a low-temperature and low-pressure state. The indoor heat exchanger 52, the outdoor heat exchanger 54, the small-capacity and large-capacity compressors 56 and 66, and the expansion device 58 are connected by a refrigerant pipe 59.

Both the above small-capacity and large-capacity compressors 56 and 66 are constant speed compressors or variable capacity compressors. Alternatively, one of the above small-capacity and large-capacity compressors 56 and 66 is a variable capacity compressor and the other of the above small-capacity and large-capacity compressors 56 and 66 is a constant speed compressor.

Preferably, the small-capacity compressor 56 has a capacity of 20~40% of the total capacity of the small-capacity and large-capacity compressors 56 and 66, and the large-capacity compressor 66 has a capacity of 60~80% of the total capacity of the small-capacity and large-capacity compressors 56 and 66.

A common accumulator 74 is connected to a suction line 56*a* of the small-capacity compressor 56 and a suction line 66*a* of the large-capacity compressor 66. The common accumulator 74 serves to store a liquid refrigerant not evaporated by the indoor heat exchanger 52 or the outdoor heat exchanger 54, in order to prevent the liquid refrigerant from being introduced into the small-capacity and large-capacity compressors 56 and 66.

Check valves 82 and 84 are respectively installed in a discharge line 56*b* of the small-capacity compressor 56 and a discharge line 66*b* of the large-capacity compressor 66. The check valves 82 and 84 serve to prevent the refrigerant discharged from the currently-operating compressor, for example, the small-capacity compressor 56, from being introduced into the currently-stopped compressor, for example, the large-capacity compressor 66.

The air conditioner further comprises a temperature sensor 92 for sensing a room temperature, an operating panel 94 for allowing a user to manipulate the operation of the air conditioner and to input a desirable target temperature, and a control unit 96 for determining, in response to signals outputted from the temperature sensor 92 and the operating panel 94, whether the small-capacity and large-capacity compressors 56 and 66 are to be operated or stopped, and then outputting control signals to the small-capacity and large-capacity compressors 56 and 66.

The reference numeral 98 denotes a direction change valve, for a 4-way valve, adapted to change the flow direction of the refrigerant in accordance with a control signal generated from the control unit 96 in response to an operation of the operating panel 94 so that the air conditioner is used for a cooling or heating purpose. This 4-way valve 98 communicates with the common accumulator 74 and the discharge lines 56*b* and 66*b* of the small-capacity and large-capacity compressors 56 and 66. The 4-way valve 98 guides the high-temperature and high-pressure gaseous refrigerant compressed by the small-capacity compressor 56 or the large-capacity compressor 66 to the outdoor heat exchanger 54 in a cooling mode, while it guides the same gaseous refrigerant to the indoor heat exchanger 52 in a heating mode.

Figure 3:
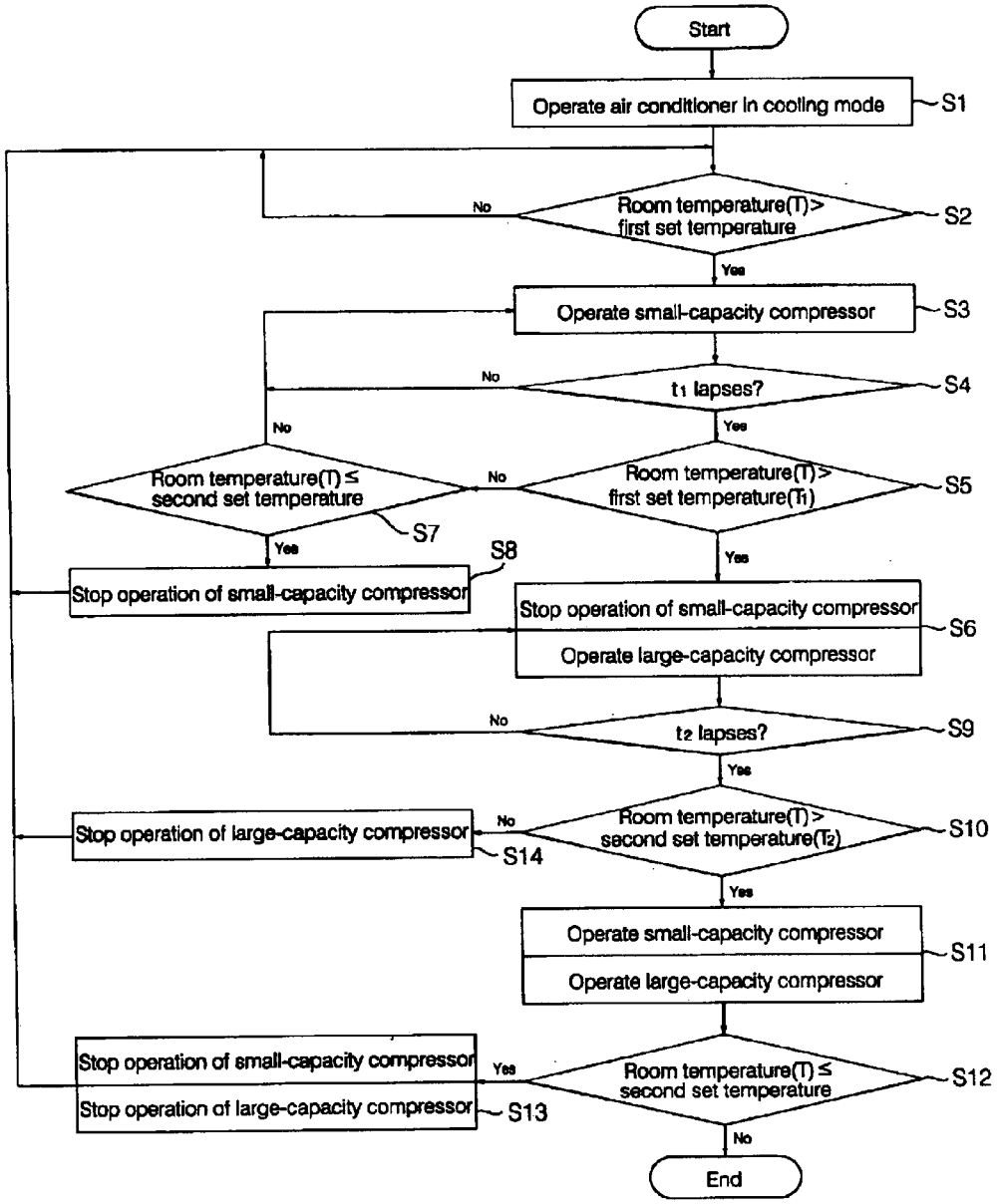
FIG. 3 is a flow chart of a method for operating the air conditioner in a cooling mode in accordance with the present invention.
Figure 4:
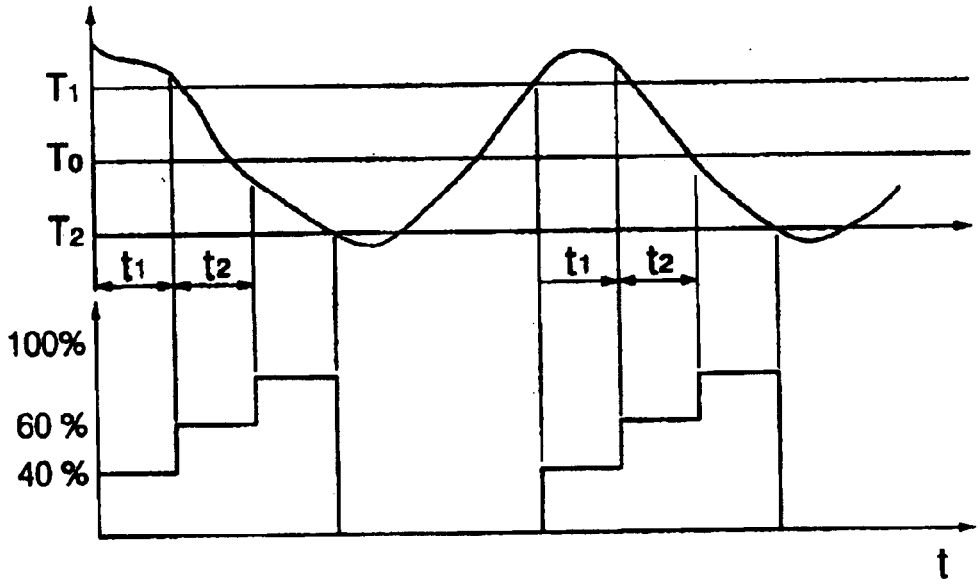
FIG. 4 is a graph illustrating the operation of compressors in accordance with the variation of a room temperature in the cooling mode of the air conditioner of the present invention.

FIG. 3 is a flow chart of a method for operating the air conditioner in a cooling mode in accordance with the present invention. FIG. 4 is a graph illustrating the operation of compressors in accordance with the variation of a room temperature in the cooling mode of the air conditioner of the present invention.

Hereinafter, the method for operating the above-described air conditioner of the present invention will be described with reference to FIGS. 2 to 4.

First, the air conditioner is set to be operated in a cooling mode under the condition in which a target temperature $T_0$ is set, in accordance with the manipulation of the operating panel 94 by a user. Then, the control unit 96 switches the operating position of the 4-way valve 98 to correspond to the cooling mode, and compares the room temperature T with a first set temperature $T_1$. When it is determined that the room temperature T is higher than the first set temperature $T_1$, the control unit 96 operates the small-capacity compressor 56 independently (S1, S2 and S3).

Here, the first set temperature $T_1$ is an upper temperature limit represented by $(T_0+\Delta T)$ being higher than the target temperature $T_0$ by an allowable temperature deviation $\Delta T$ of, for example, 1° C. That is, the first set temperature $T_1$ is a reference temperature for determining whether the small-capacity compressor 56 is operated or stopped.

When the small-capacity compressor 56 is independently operated, the small-capacity compressor 56 discharges a refrigerant in a high-temperature and high-pressure gaseous state to the outdoor heat exchanger 54. The refrigerant passing through the outdoor heat exchanger 54 is heat-exchanged with the peripheral air, thereby radiating heat and then being condensed. The refrigerant in a high-temperature and high-pressure liquid state condensed by the outdoor heat exchanger 54 passes through the expansion device 58, thereby being expanded into a low-temperature and low-pressure state inducing evaporation and then transferred to the indoor heat exchanger 52.

When the refrigerant passes through the indoor heat exchanger 52, the refrigerant in the low-temperature and low-pressure liquid state is heat-exchanged with air in a room, thus absorbing heat and then being evaporated. Then, the refrigerant is introduced again into the small-capacity compressor 56. Thereby, a cooling cycle is established, and the room temperature T is lowered by the heat absorption function of the indoor heat exchanger 52.

After a first predetermined time $t_1$ from the beginning of the independent operation of the small-capacity compressor 56 lapses, the control unit 96 compares the room temperature T with the first set temperature $T_1$ (S4 and S5)

Here, the first predetermined time $t_1$ is a reference time for assuring the reliability in the variation of the room temperature during the independent operation of the small-capacity compressor 56, for example, 1 minute.

When the room temperature T does not reach the first set temperature $T_1$, i.e., the upper limit temperature represented by $(T_0+\Delta T)$ being higher than the target temperature $T_0$ by the allowable temperature deviation $\Delta T$, that is, when the room temperature T is higher than the first set temperature $T_1$, the control unit 96 determines that the cooling load in the room is large and not eliminated by the independent operation of the small-capacity compressor 56. Then, the control unit 96 stops the operation of the small-capacity compressor 56, and operates the large-capacity compressor 66 independently (S6).

When the large-capacity compressor 66 is independently operated, the large-capacity compressor 66 discharges a refrigerant in a high-temperature and high-pressure gaseous state with an amount larger than that of the refrigerant discharged by the operation of the small-capacity compressor 56 to the outdoor heat exchanger 54. Then, the cooling cycle is established by the operation of the large-capacity compressor 66, the same as the operation of the small-capacity compressor 56, and the room temperature T is lowered by the heat absorption function of the indoor heat exchanger 52.

Here, compared with the operation of the small-capacity compressor 56, a larger amount of the refrigerant passes through the indoor heat exchanger 52, thereby more lowly dropping the room temperature.

On the other hand, after the first predetermined time $t_1$ lapses, when the room temperature T reaches the first set temperature $T_1$, that is, when the room temperature T is not higher than the upper limit temperature represented by $(T_0+\Delta T)$, the control unit 96 determines that the cooling load in the room can be eliminated by the independent operation of the small-capacity compressor 56, and continuously operates the small-capacity compressor 56. Then, when the room temperature T is not higher than a second set temperature $T_2$, in order to prevent the overcooling of the room, the control unit 96 stops the operation of the small-capacity compressor 56 (S7 and S8). After the independent operation/stoppage of the small-capacity compressor 56, the procedure from step S1 to step S8 is repeated.

Here, the second set temperature $T_2$ is a lower temperature limit represented by $(T_0-\Delta T)$ being lower than the target temperature $T_0$ by the allowable temperature deviation $\Delta T$. That is, the same as the first set temperature $T_1$, the second set temperature $T_2$ is a reference temperature for determining whether the small-capacity compressor 56 is operated or stopped.

As described above, whether the operation of the small-capacity compressor 56 is stopped or not may be determined by the second set temperature $T_2$. Otherwise, when the room temperature T is less than the target temperature $T_0$, the operation of the small-capacity compressor 56 may be stopped.

After a second predetermined time $t_2$ from the beginning of the independent operation of the large-capacity compressor 66 lapses, the control unit 96 compares the room temperature T with the second set temperature $T_2$ (S9 and S10).

Here, the second predetermined time $t_2$ is a reference time for assuring the reliability in the variation of the room temperature during the independent operation of the large-capacity compressor 66, for example, 1 minute.

The second set temperature $T_2$ is a reference temperature for determining whether the large-capacity compressor 66 as well as the small-capacity compressor 56 is operated or stopped.

When the room temperature T does not reach the second set temperature $T_2$, i.e., the lower limit temperature represented by $(T_0-\Delta T)$ being lower than the target temperature $T_0$ by the allowable temperature deviation $\Delta T$, that is, when the room temperature T is higher than the second set temperature $T_2$, the control unit 96 determines that the cooling load in the room is large and not eliminated by the independent operation of the large-capacity compressor 66. Accordingly, the control unit 96 operates the small-capacity compressor 56 together with the operation of the large-capacity compressor 66 (S11).

When the small-capacity and large-capacity compressors 56 and 66 are operated simultaneously, the small-capacity and large-capacity compressors 56 and 66 discharge the refrigerant in a high-temperature and high-pressure gaseous state, with the total amount larger than the refrigerant discharged by the independent operation of the small-capacity compressor 56 or the independent operation of the large-capacity compressor 66, to the outdoor heat exchanger 54. Then, the cooling cycle is established by the simultaneous operation of the small-capacity and large-capacity compressors 56 and 66, the same as the independent operation of the small-capacity compressor 56 or the independent operation of the large-capacity compressor 66, and the room temperature T is lowered by the heat absorption function of the indoor heat exchanger 52.

Here, compared with the independent operation of the small-capacity or large-capacity compressor 56 or 66, a larger amount of the refrigerant passes through the indoor heat exchanger 52, thereby more lowly dropping the room temperature.

Thereafter, when the room temperature T is less than the second set temperature $T_2$, i.e., the lower limit temperature of $(T_0-\Delta T)$ by the simultaneous operation of the small-capacity and large-capacity compressors 56 and 66, the control unit 96 determines that the cooling load within the room is completely eliminated. Then, in order to prevent the room from being overcooled, the control unit 96 stops the operation of the small-capacity and large-capacity compressors 56 and 66 (S12 and S13).

On the other hand, after the second predetermined time $t_2$ lapses, when the room temperature T reaches the second set temperature $T_2$, that is, when the room temperature T is not higher than the lower limit temperature of $(T_0-\Delta T)$, the control unit 96 determines that the cooling load in the room is eliminated by the independent operation of the large-capacity compressor 66, and stops the operation of the large-capacity compressor 66 in order to prevent the room from being overcooled (S14). After the independent operation/stoppage of the large-capacity compressor 66, the procedure from step S1 to step S14 is repeated.

Then, after the independent operation/stoppage of the small-capacity compressor 56, the independent operation of the large-capacity compressor 66, and the simultaneous operation/stoppage of the small-capacity and large-capacity compressors 56 and 66, the above procedure is repeated.

Although the second set temperature $T_2$ is adapted as the reference time after the independent operation of the large-capacity compressor 66 in this embodiment of the present invention, the second set temperature $T_2$ may be adapted as a reference time after the independent operation of the small-capacity compressor 56.

The air conditioner and the method for operating the air conditioner in a cooling mode in accordance with the present invention have several advantages, as follows.

First, the air conditioner comprises small-capacity and large-capacity compressors for compressing a refrigerant, and a control unit for controlling the independent or simultaneous operation of the small-capacity and large-capacity compressors so that the room temperature is maintained in the range of the upper or lower allowable limits of the target temperature when it is determined that a cooling load in the room is large by comparing a room temperature with the upper or lower allowable limits of the target temperature inputted through an operating panel. Accordingly, it is possible to reduce an electric power consumption rate.

Second, the small-capacity compressor is independently operated, and when it is determined that a cooling load is large after the lapse of a first predetermined time from the beginning of the independent operation of the small-capacity compressor, the small-capacity compressor is stopped and the large-capacity compressor is independently operated. Thereafter, when it is determined again that the cooling load is large after the lapse of a second predetermined time from the beginning of the independent operation of the small-capacity compressor, the small-capacity compressor is re-operated together with the operation of the large-capacity compressor. Accordingly, it is possible to rapidly cope with the variation of the cooling load.

Third, a first set temperature serving as the upper temperature limit is set to be higher than the target temperature by an allowable variation and a second set temperature serving as the lower temperature limit is set to be lower than the target temperature by the allowable variation, thereby allowing the small-capacity and large-capacity compressors to be operated and/or stopped in accordance with the variation of the cooling load to be eliminated so that the room temperature is maintained in the range of the upper and lower limits of the target temperature.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for operating an air conditioner in a cooling mode for cooling air in a room by an independent or simultaneous operation of small-capacity and large-capacity compressors in accordance with the variation of a cooling load, comprising the steps of:

(a) operating the small-capacity compressor;

(b) stopping the operation of the small-capacity compressor and operating the large-capacity compressor when it is determined that the room temperature is higher than a first set temperature after the lapse of a first predetermined time after the small-capacity compressor is operated at the step (a); and (c) re-operating the small-capacity compressor together with the operation of the large-capacity compressor when it is determined that the room temperature is higher than a second set temperature after the lapse of a second predetermined time after the large-capacity compressor is operated at the step (b).

2. The method as set forth in claim 1, wherein the step (b) includes the step of comparing the room temperature to the first set temperature after the lapse of the first predetermined time from the beginning of the operation of the small-capacity compressor at the step (a).

3. The method as set forth in claim 1, wherein the first set temperature is higher than the target temperature inputted by the user by a predetermined value.

4. The method as set forth in claim 1, wherein the step (c) includes the step of comparing the room temperature to the second set temperature after the lapse of the second predetermined time from the beginning of the operation of the large-capacity compressor at the step (b).

5. The method as set forth in claim 1, wherein the step (c) includes the step of comparing the room temperature to the second set temperature after the lapse of the second predetermined time from the beginning of the operation of the small-capacity compressor at the step (a).

6. The method as set forth in claim 1, wherein the second set temperature is lower than the target temperature inputted by the user by a predetermined value.

7. The method as set forth in claim 1, wherein the step (a) includes the step of operating the small-capacity compressor when the air conditioner is operated in the cooling mode.

8. The method as set forth in claim 1, wherein the step (a) includes the step of operating the small-capacity compressor when the room temperature is higher than the first set temperature.

9. The method as set forth in claim 1, wherein the step (b) includes the step of maintaining the operation of the small-capacity compressor when the room temperature is not higher than the first set temperature after the lapse of the first predetermined time after the small-capacity compressor is operated.

10. The method as set forth in claim 9, wherein the step (b) includes the step of stopping the operation of the small-capacity compressor when the room temperature is not higher than the second set temperature after the maintenance of the operation of the small-capacity compressor.

11. The method as set forth in claim 10, wherein the procedure from the step (a) to the step (c) is repeated when the room temperature is higher than the first set temperature after the stoppage of the operation of the small-capacity compressor.

12. The method as set forth in claim 1, wherein the step (c) includes the step of stopping the large-capacity compressor when the room temperature is not higher than the second set temperature after the lapse of the second predetermined time after the large-capacity compressor is operated.

13. The method as set forth in claim 1, wherein the procedure from the step (a) to the step (c) is repeated when the room temperature is higher than the first set temperature after the stoppage of the operation of the large-capacity compressor.

14. The method as set forth in claim 1, further comprising the step of (d) stopping the operation of the small-capacity and large-capacity compressors when the room temperature is not higher than the second set temperature after the step (c).

15. The method as set forth is claim 14, wherein the procedure from the step (a) to the step (d) is repeated.

* * * * *

UNITED STATES PATENT AND TRADEMARK OFFICE

CERTIFICATE OF CORRECTION

PATENT NO. : 6,829,903 B2
DATED : December 14, 2004
INVENTOR(S) : W. Lee et al.

It is certified that error appears in the above-identified patent and that said Letters Patent is hereby corrected as shown below:

Column 10,
Line 20, "is" should be -- in --.

Signed and Sealed this

Sixteenth Day of August, 2005

JON W. DUDAS
*Director of the United States Patent and Trademark Office*